US007823336B2

(12) United States Patent
Brochu et al.

(10) Patent No.: US 7,823,336 B2
(45) **Date of Patent: *Nov. 2, 2010**

(54) SOFFIT SUPPORT

(76) Inventors: Guy Brochu, Québec (CA); Stéphane Brochu, St-Romuald (CA)

( * ) Notice: Subject to any disclaimer, the term of this patent is extended or adjusted under 35 U.S.C. 154(b) by 375 days.

This patent is subject to a terminal disclaimer.

(21) Appl. No.: 11/589,569

(22) Filed: Oct. 30, 2006

(65) Prior Publication Data

US 2007/0107320 A1 May 17, 2007

Related U.S. Application Data

(63) Continuation-in-part of application No. 10/797,830, filed on Mar. 10, 2004, now abandoned.

(51) Int. Cl.
*E04D 1/36* (2006.01)
*E04D 3/38* (2006.01)
*E04D 13/14* (2006.01)

(52) U.S. Cl. ..... 52/60; 52/97; 52/716.2; 52/718.04; 52/94

(58) Field of Classification Search ..... 52/22, 52/58, 60, 97, 716.2, 718.04, 457, 717.06, 52/746.11; D25/164; 248/48.1, 48.2
See application file for complete search history.

(56) References Cited

U.S. PATENT DOCUMENTS

| | | | | | |
|---|---|---|---|---|---|
| 3,181,275 | A * | 5/1965 | Schroter et al. | ..... | 52/73 |
| 4,226,056 | A * | 10/1980 | Hallam | ..... | 52/11 |
| 4,347,691 | A * | 9/1982 | Lloyd-Jones | ..... | 52/95 |
| 4,962,622 | A * | 10/1990 | Albrecht et al. | ..... | 52/630 |
| D340,532 | S * | 10/1993 | Jansen | ..... | D25/119 |
| 5,426,901 | A * | 6/1995 | Indracek | ..... | 52/288.1 |
| 5,735,084 | A * | 4/1998 | Zaccagni et al. | ..... | 52/11 |
| 6,539,675 | B1 * | 4/2003 | Gile | ..... | 52/96 |
| 7,367,163 | B2 * | 5/2008 | Brochu et al. | ..... | 52/60 |

* cited by examiner

*Primary Examiner*—Richard E Chilcot, Jr.
*Assistant Examiner*—Chi Nguyen
(74) *Attorney, Agent, or Firm*—Eric Fincham

(57) ABSTRACT

A fascia and soffit system having a fascia component, a soffit component and a soffit support structure, the fascia component comprising first and second members which are adjustable with respect to each other to permit different heights, the soffit having a plurality of apertures formed therein to permit air passage, the soffit support structure comprising first and second members which are retained in position by an interlocking system.

7 Claims, 8 Drawing Sheets

SOFFIT SUPPORT

This application is a Continuation-In-Part of application Ser. No. 10/797,830 filed Mar. 10, 2004 now abandoned.

FIELD OF THE INVENTION

The present invention relates to an improved fascia and soffit structure for buildings.

BACKGROUND OF THE INVENTION

The fascia is that part of a building where the roof terminates. Typically, most residences and relatively small commercial or industrial establishments utilize a sloping roof. The roof structure includes a plurality of rafters upon which a solid material such as plywood or the like is placed. Subsequently, a weatherproofing component is applied on top thereof, the weatherproofing component typically being asphalt tiles although metal, shakes, other types of tiles, and composite materials have all been known to be utilised.

At the point where the rafters terminate, a fascia is installed and extends along the ends of the rafters. Typically, the fascia may comprise a wooden member and/or a metal member secured to the rafter ends. Typically, the metal member has an L-shaped configuration which extends along the fascia and inwardly towards the soffit portion of the eaves.

A soffit structure is generally utilized to provide ventilation to the air space under the roof. Typically, the soffit will comprise a piece of metal or plastic having apertures therein to permit the passage of air into the air space. A second outlet such as a roof vent is provided to encourage the flow of air therethrough.

The arrangement of the fascia and soffit has essentially not changed for many years. The fascia will usually comprise a wooden strip nailed along the ends of the rafters and this is then covered by a metal or plastic fascia member. However, it is also known to only use the metal or plastic fascia.

SUMMARY OF THE INVENTION

It is an object of the present invention to provide an integrated fascia and soffit structure.

According to one aspect of the present invention, there is provided a fascia and soffit system comprising a fascia component, a soffit component, and a soffit support structure, the fascia component comprising a first member and a second member, the first member having an upper section designed for securement to an upper surface of a roof member, a drip edge formed at an extremity of the upper section, a transition section extending inwardly and downwardly from the first section, and a lower section extending vertically downwardly from the transition section, the lower having first cooperative locking means on an inner side thereof, the second member comprising a fascia member having second cooperative locking means extending outwardly from an upper portion of the fascia member, an inwardly extending flange arrangement at the bottom end of the generally planar portion assigned to an abut and a joining soffit, the soffit support structure comprising a first member having a central vertical section, a support element extending outwardly from a lower portion of the central vertical section, a retaining structure located proximate an upper portion of the central vertical section, a second member having a second member central section adapted to lie adjacent the central section of the first member, the second member having engaging means located at a lower portion of the central section, the engaging means being designed to engage the support element of the first member, the second member having a second portion extending upwardly and outwardly to abut a soffit, the arrangement being such that the second member central section is retained between the retaining structure of the first member and the support element of the first member.

The first member of the soffit support structure is designed to be secured to a substrate and to retain and support the second member which in turn supports the soffit. As such, the first member will have a section which is designed to lie adjacent to a vertical structure such as the building wall and will also have a section which is designed to lie underneath the soffit.

The first member, in order to fulfill its function as a means of securing and retaining the second member, has to ensure that the second member remains securely retained in position, preferably without the use of any fastening members.

To this end, the first member may be secured either through the vertical portion to an adjacent wall or alternatively along the horizontal portion to the underside of the roof structure. If desired, the first member could be secured to both of the structures. The means for fastening the first member may include all the conventional methods including the use of mechanical fastening members, adhesives, etc.

The second member has a first section which is designed to be secured to and retained by the first member, and a second section which is designed to support the soffit.

The first section is designed to be retained by and secured to the first member and preferably is retained by means of a slight compression thereof. To this end, the first section of the second member has its upper and lower portions engaged by the first member. Conveniently, this is accomplished by engaging means located at a lower portion of the first section and which engaging means seat on the lower support element of the first member while an upper portion is retained within a channel formed at an upper portion of the vertical section of the first member.

The fascia system of the present invention would typically be manufactured from a sheet metal such as aluminum or an aluminum alloy which can easily be formed into various configurations by known methods. However, it is also within the scope of the invention to use other materials such as a plastic material which could be extruded or otherwise formed into the desired configurations.

As aforementioned, the fascia system includes a first member and a second member, the first member being secured to the building structure and being designed to support the second member in a desired position.

In a preferred embodiment of the invention, the first member has an upper section which is designed for securement to the roof; the upper section would conventionally be secured to the top of the sheet material attached to the rafters—i.e. plywood or other composite products. The means of securing may be any conventional including adhesives and/or mechanical securement means such as nails and screws.

The upper section preferably includes a first portion which is secured to the roof as aforementioned and a second portion which will extend outwardly from the roof edge and which second portion is slightly angled with respect to the first portion. It is the second portion which will terminate in a drip edge.

There is also provided a lower section which includes a generally vertically extending portion designed to lie adjacent the fascia's structure. A transition section extends between the drip edge and the vertically extending portion. In this respect, from the drip edge, there is preferably provided a segment which extends upwardly to thereby define the drip edge and which will then extend downwardly to the generally vertically extending portion.

The generally vertically extending portion will have a first cooperative locking means associated therewith. Although many such cooperative locking means can be envisaged, one of the simpler structures will include a formed hook and recess engagement as will be discussed hereinbelow.

The second member is the portion which covers the fascia. At the upper end, the second member is provided with a second cooperative locking means designed to engage with the first cooperative locking means. Conveniently, as aforementioned, this may be provided by a plurality of hooks or projections extending outwardly from the second member and which are designed to engage within recesses or other supports of the first cooperative locking means. An advantage of such an arrangement is that they may easily be provided by conventional metal forming equipment well known in the art.

Preferably, the first and second cooperative locking means are adjustable with respect to each other such that they may be engaged in different positions. By so doing, a arrangement is provided for differing fascia heights.

The second member, as aforementioned, actually forms or covers the fascia and as such, is substantially plainer in nature although certain embossing or spacing projections may be provided as will be discussed with respect to the preferred embodiment.

At the lower end, the second member is provided with an inwardly extending portion which is designed to abut the soffit structure of the building. In a particularly preferred arrangement, the lower portion of the second member is formed to have a recess at a lower extremity defined by the lower portion of the vertically extending wall and the inwardly extending portion. This recess may be utilized to accommodate a tensioning member which is secured to the roof structure and which engages the lower portion of the second member. To this end, the tensioning member will, as aforementioned, be secured to the roof structure and have a downwardly extending portion designed to seat within the aforesaid recess. Preferably, the tensioning member has a certain resilience and to this end, may be provided with a sinusoidal portion to provide the desired resiliency.

The soffit structure S is preferably that shown and described in co-pending patent application Ser. No. 10/780,193, the teachings of which are hereby incorporated by reference. However, it will be appreciated that other structures might be employed.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
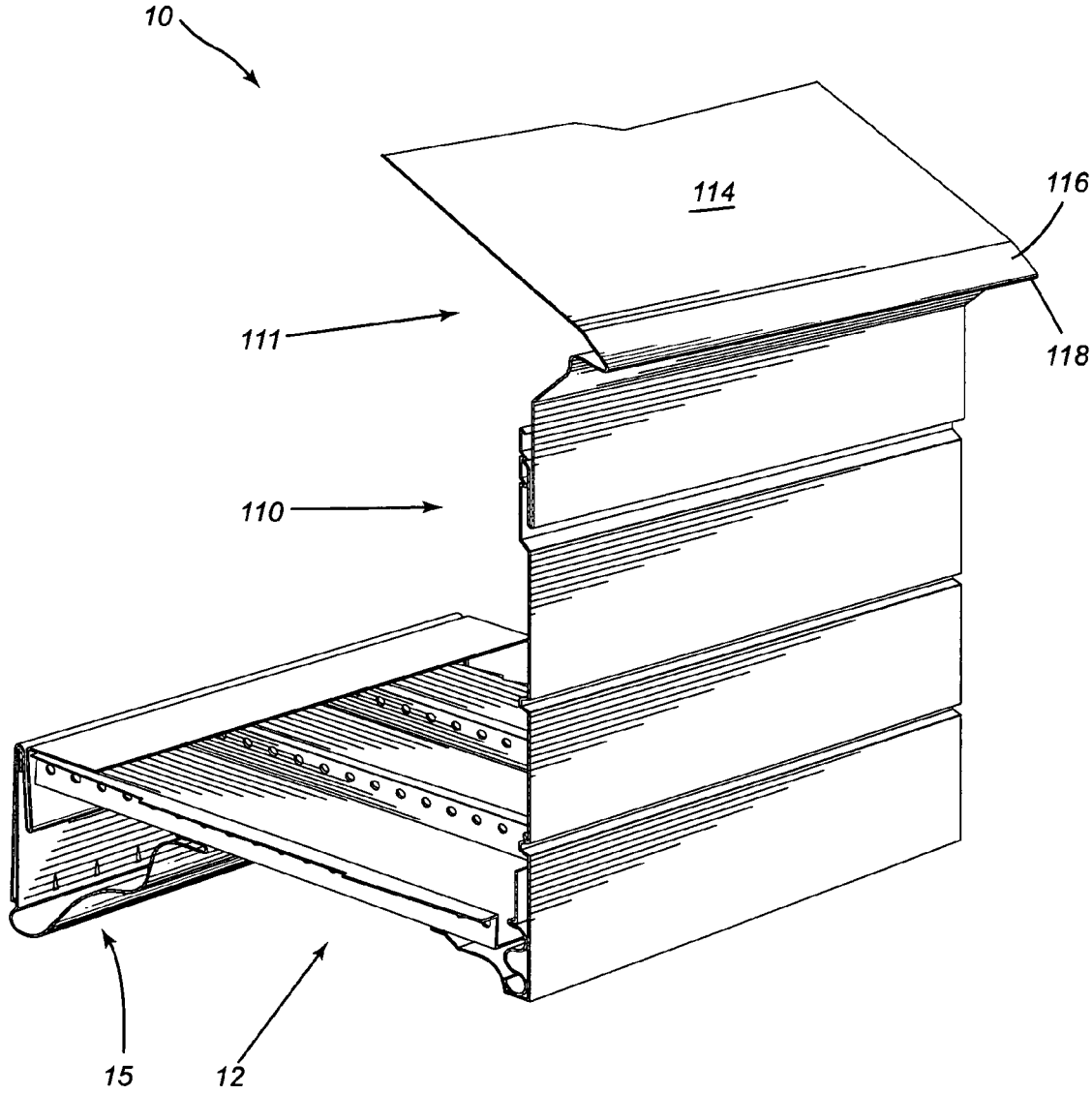
FIG. 1 is a perspective view of the support structure for a soffit in conjunction with a soffit and a fascia system.

The fascia and soffit system of the present invention is generally designated by reference numeral 10 and includes a fascia component generally designated by reference numeral 110, a soffit structure generally designated by reference numeral 12 and a soffit support component generally designated by reference numeral 15.

Figure 3:
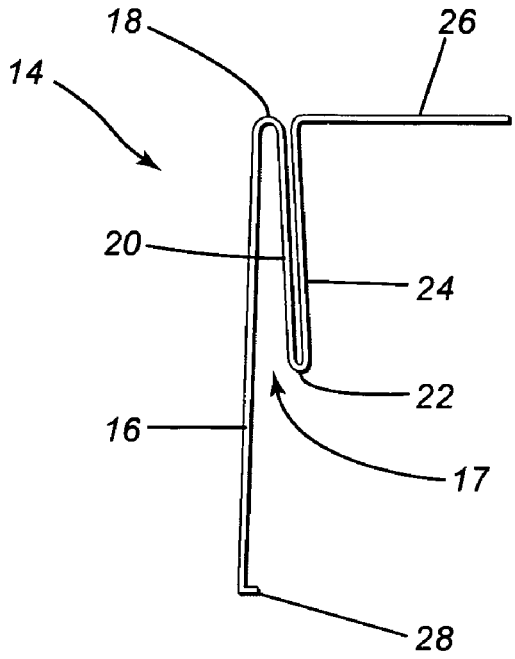
FIG. 3 is a side sectional view of the first member of the support structure.
Figure 4:
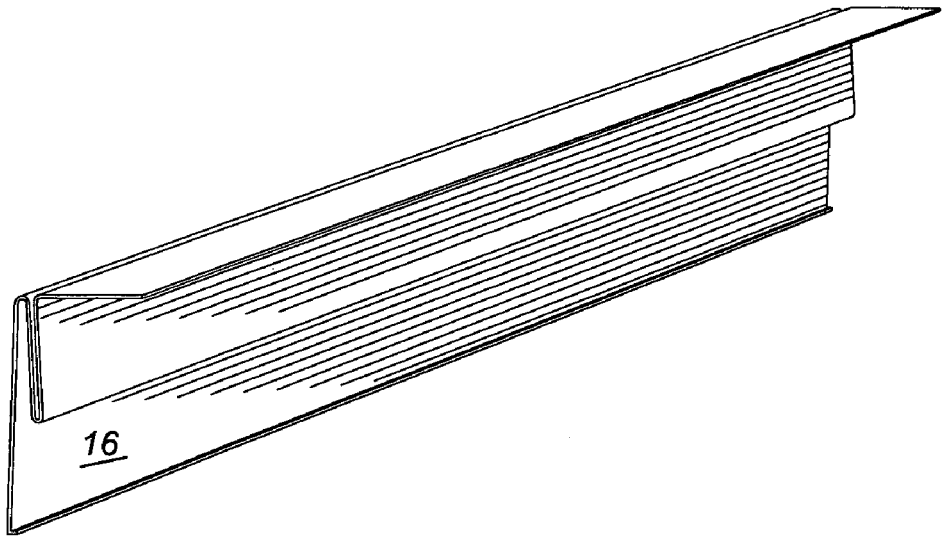
FIG. 4 is a perspective view thereof.

The soffit support component of the present invention includes a first member generally designated by reference numeral 14 (FIG. 3). First member 14 has a vertical wall section 16 which, at its upper end, terminates in an upper bight 18. Extending downwardly from upper bight 18 is a second vertical section 20 which likewise terminates in a lower bight 22. As may be seen in FIG. 3, a channel 17 is thus formed between sections 16 and 20. Channel 17 has an inwardly tapered configuration.

From lower bight 22, first member 14 has an upwardly extending section 24 which terminates in a horizontal section 26.

As may be best seen in FIG. 3, at the lower end of vertical wall section 16, there is provided a flange 28 for reasons which will become apparent hereinbelow.

Figure 5:
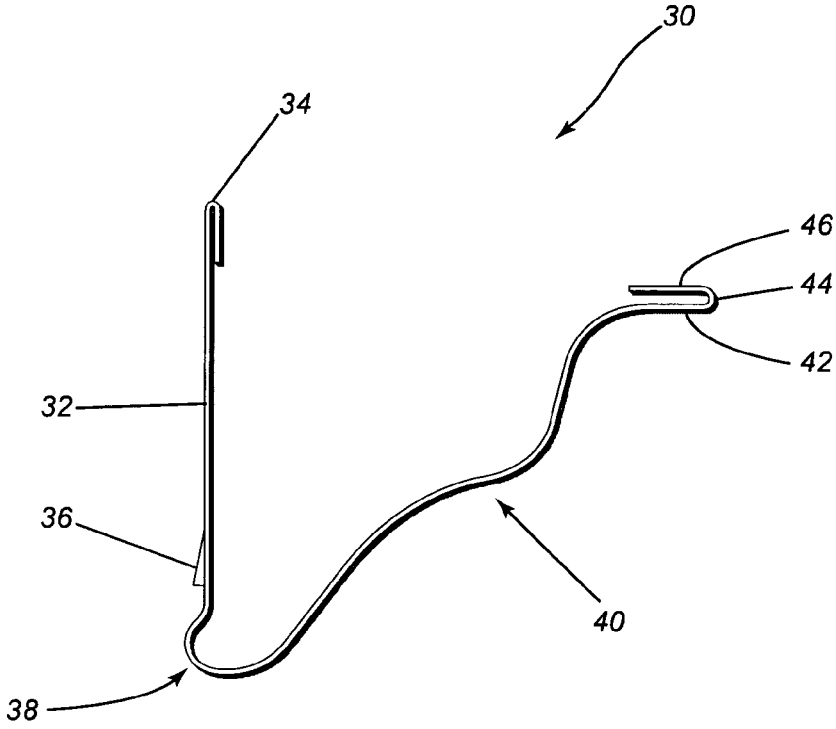
FIG. 5 is a side-sectional view of the second member of the soffit support.
Figure 6:
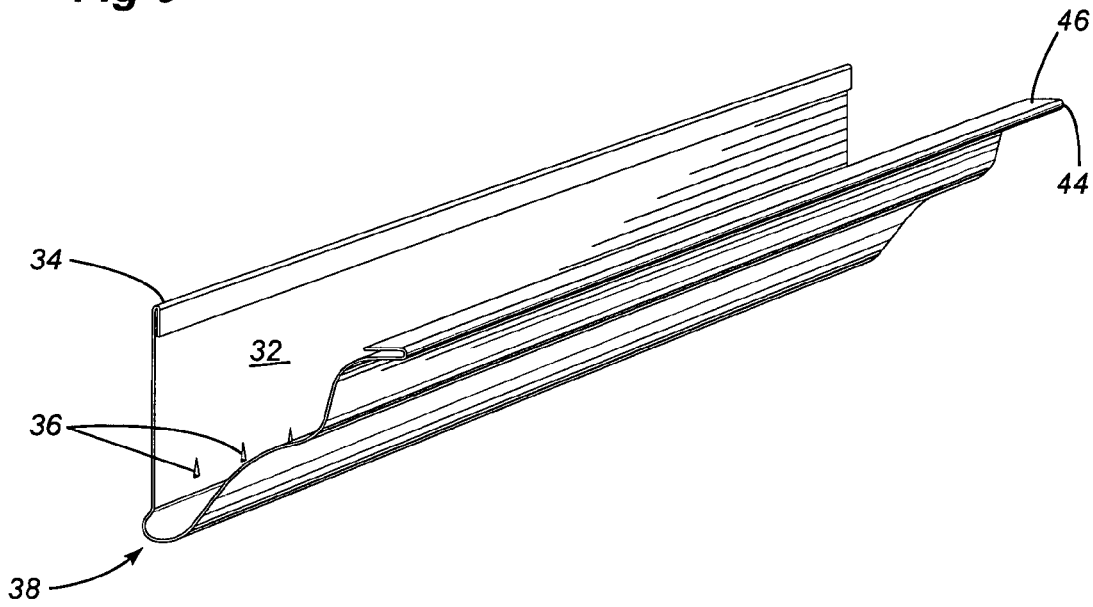
FIG. 6 is a perspective view thereof.

A second member of the soffit support is generally designated by reference numeral 30 and includes a second member central section 32 having an upper bight 34. As may be best seen in FIG. 5, tabs 36 are formed within central section 32 and extend rearwardly thereof.

At the lower end of central section 32, there is provided an arcuate section generally designated by reference numeral 38 and which in turn continues as a diagonally extending side wall generally designated by reference numeral 40. Side wall 40 terminates in a horizontal section 42 which in turn continues as an inwardly turned horizontal section 46 through bight 44.

In use, first member 14 is suitably secured to a structure either by a means of vertical section 16 or horizontal section 26 by suitable means (not shown). Subsequently, central section 32 of second member 30 is inserted in channel 17 with tabs 36 resting on flange 28. Naturally, flange 28 could be angled upwardly to better engage tabs 36. The sizing is such that the top of central section 32 is frictionally engaged within channel 17 and securely held thereby. A downwardly extending pressure is put on tabs 36.

In so doing, soffit 12 is then supported by the horizontal sections 42 and 46.

The fascia component of the present invention is generally designated by reference numeral 110 and includes a first upper member designated by reference numeral 112 and which will now be referred to.

First upper member 112 includes a first upper section generally designated by reference numeral 111 and which includes a planar portion 114 which is designed to lie adjacent to a roof structure R such as is employed in a conventional house. In this respect, it will be understood that under normal circumstances, planar portion 114 will lie on the roof under the shingles or other similar roof covering.

From planar portion 114, upper section 111 includes a downwardly inclined portion 116 which is angled with respect to planar portion 114 and which terminates in a drip edge 118.

From drip edge 118, first upper member 112 has a transition section 115 comprising an upwardly and inwardly extending portion 120 which ensures the proper formation of the drip edge 118. Subsequently, there is provided a second downwardly inclined portion 122 which terminates in a lower section which comprises an outer vertical wall 124. The material forming first upper member 112 then is folded to have an inner vertical wall 126 which is formed with a plurality of recesses 128.

A second lower member generally designated by reference numeral 130 has an upper portion 132 with a plurality of hook-shaped projections 134 formed therein Second lower member 130 also includes a main planar portion generally designated by reference numeral 136 and which has formed therein a plurality of spacer projections 138. At its lower end, second lower member 130 has an inwardly extending flange portion generally designated by reference numeral 140. Inwardly extending flange portion 140 has a first horizontal section 142 which joins an arcuately upwardly concave portion 144. There is thus formed a cavity generally designed by reference numeral 145. At the end of arcuate section 144, there is provided a diagonally upwardly extending section 146 which terminates in a horizontal end portion 148.

Figure 2:
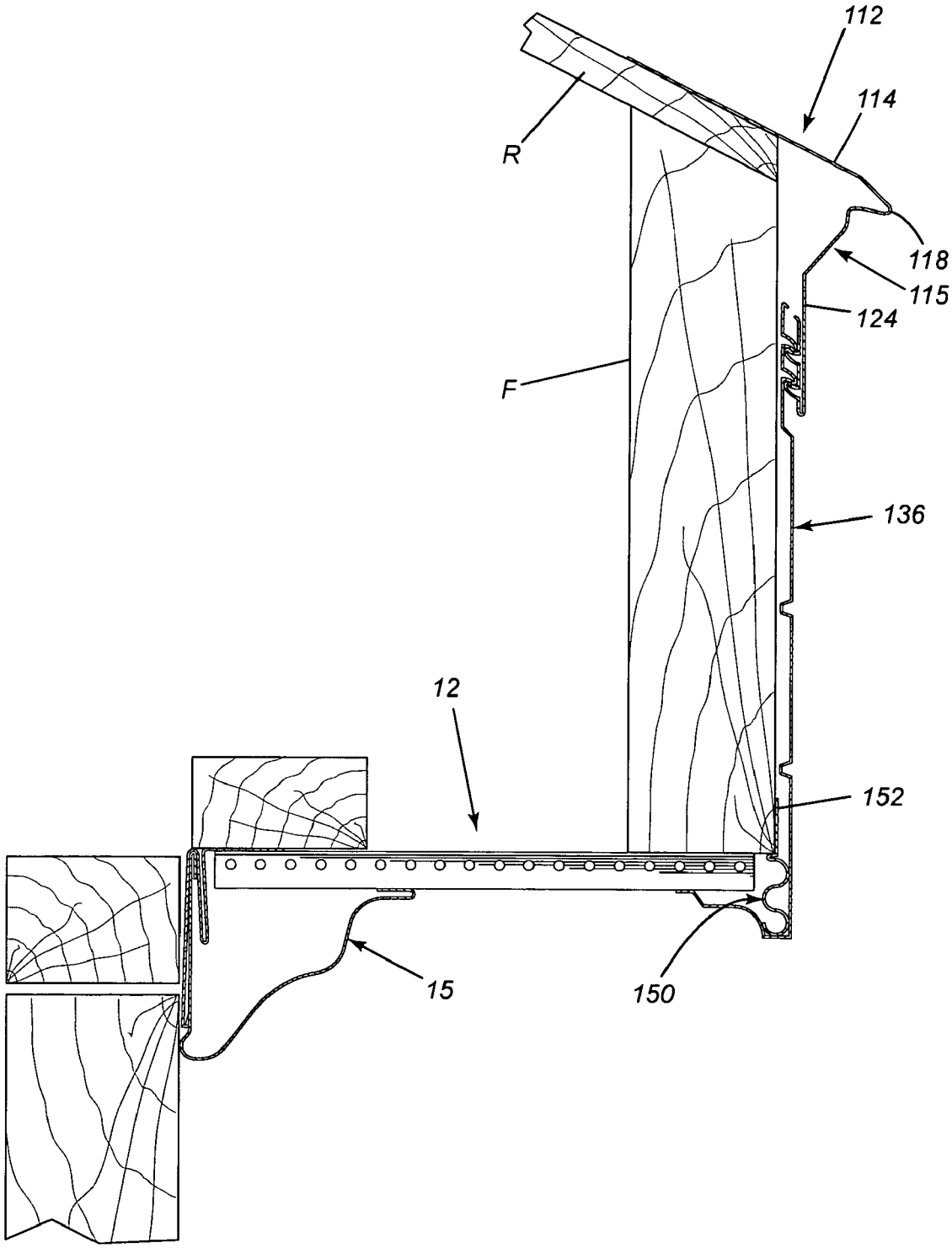
FIG. 2 is a side sectional view thereof.
Figure 7:
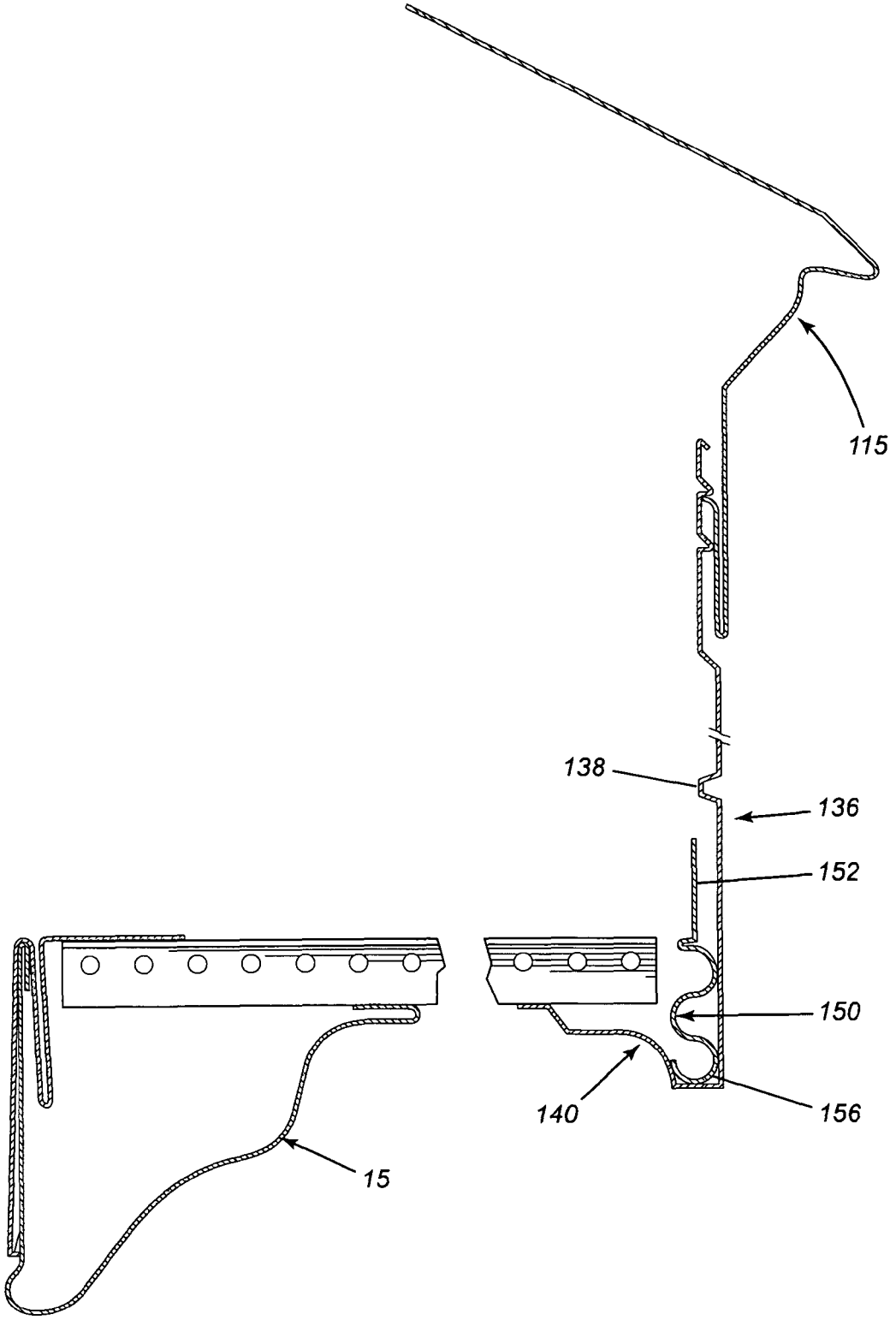
FIG. 7 is a view similar to FIG. 2 with the structural components of the housing structure being removed and showing the adjustability of the system.
Figure 12:
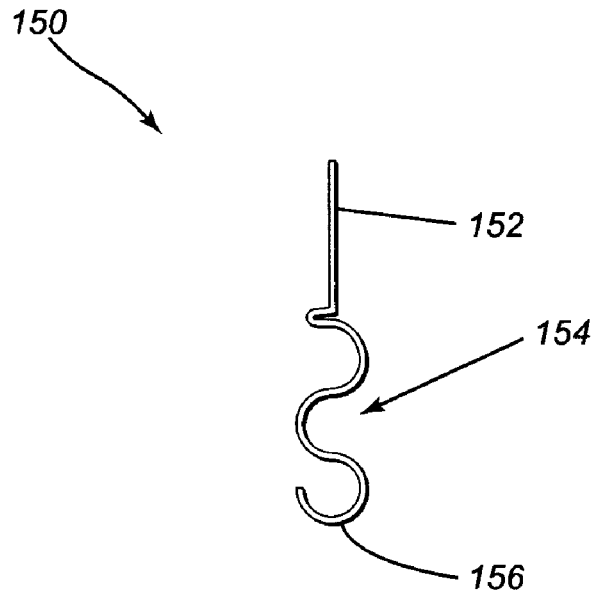
FIG. 12 is side elevational view of a tensioning member which can be utilized in the fascia system of the present invention.
Figure 13:
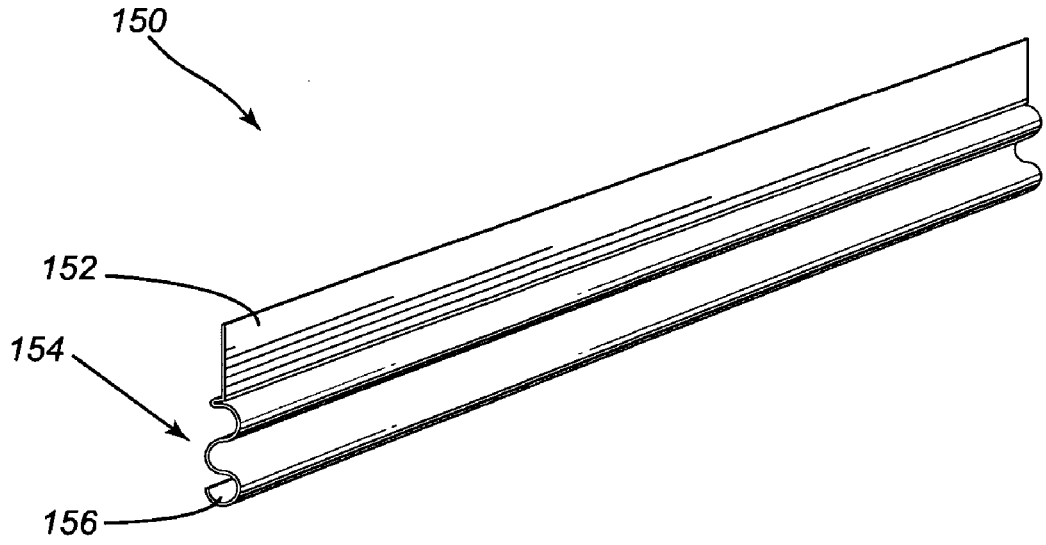
FIG. 13 is a perspective view thereof.

As best seen in FIGS. 2 and 7, there is also provided a spacer and tensioning member 150. Spacer and tensioning member 150 is illustrated in FIGS. 12 and 13 includes an upper planar portion 152, and a sinuous spring section generally designated by reference numeral 154 and which includes a plurality of arcuate sections in an overall S-shaped configuration. Sinuous section 154 terminates in a bottom section generally designated by reference numeral 156 and which is designed to seat within cavity 145.

Figure 8:
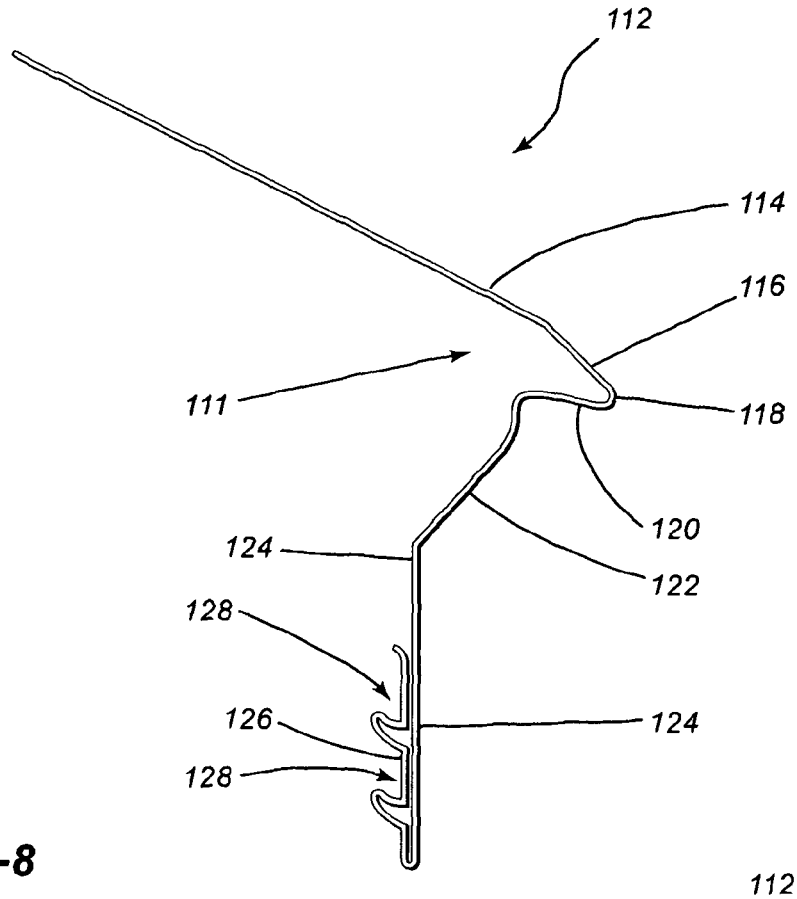
FIG. 8 is a side elevational view of the upper member of the fascia system.
Figure 9:
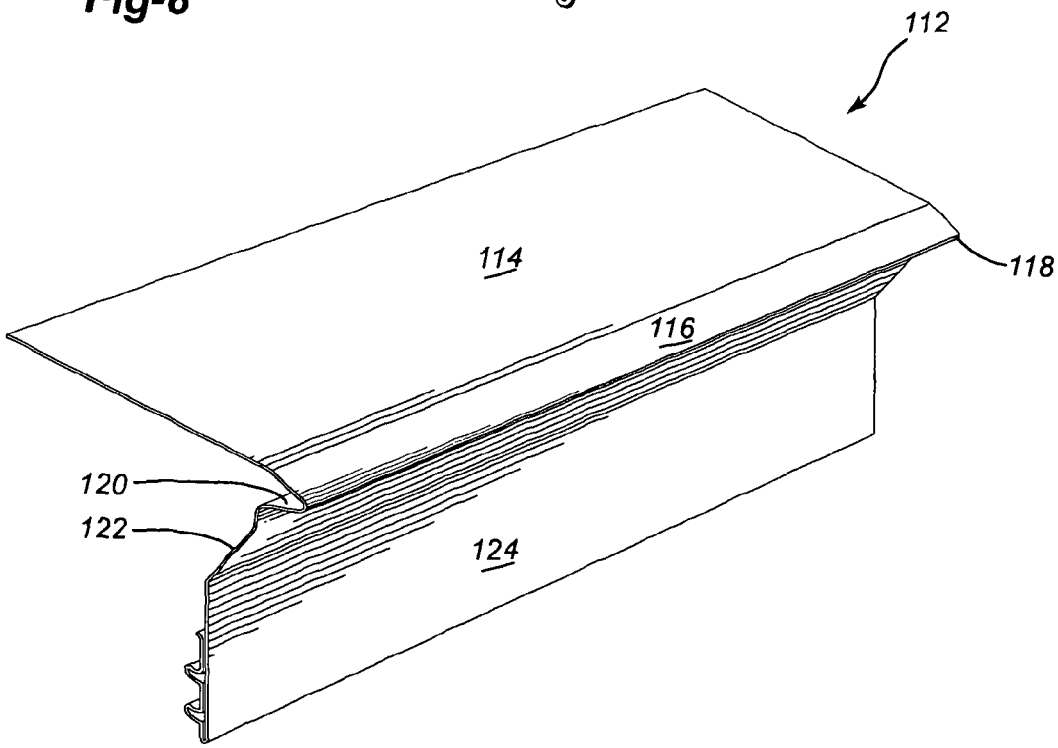
FIG. 9 is a perspective view thereof.
Figure 10:
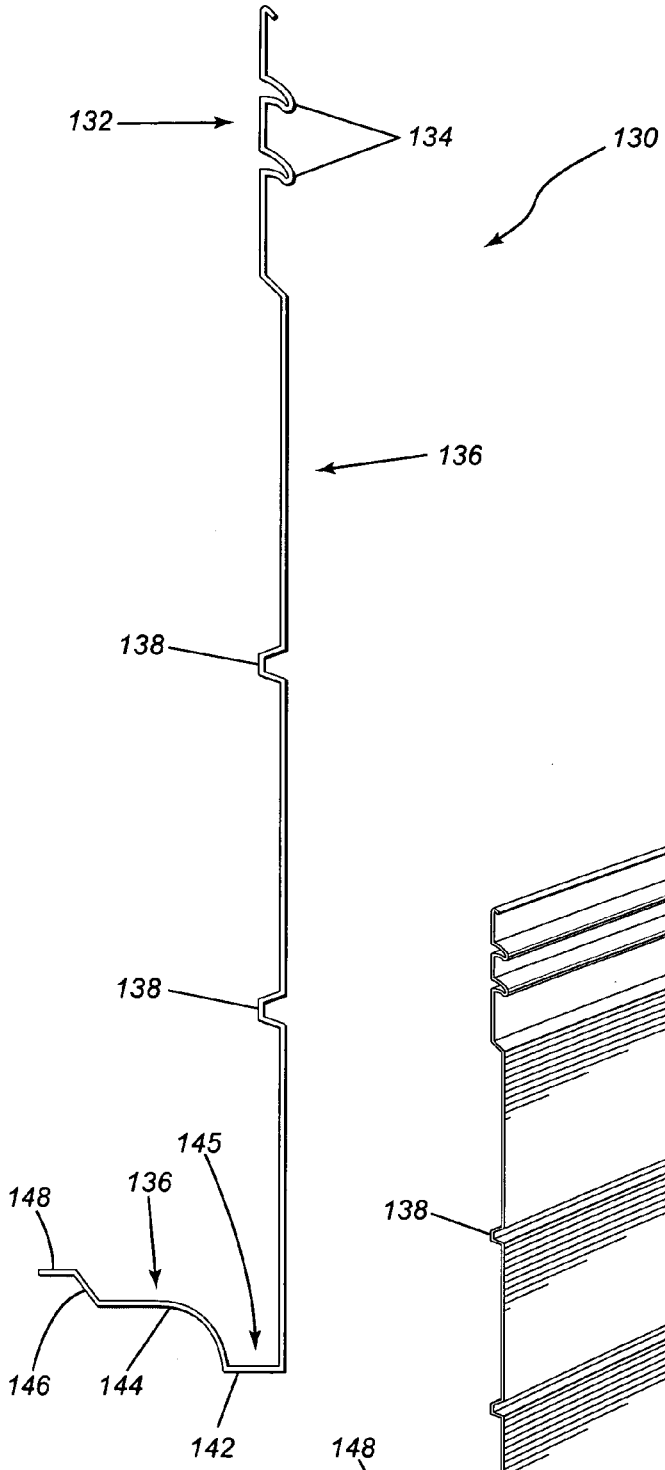
FIG. 10 is a side elevational view of the lower member of the fascia system according to the present invention.
Figure 11:
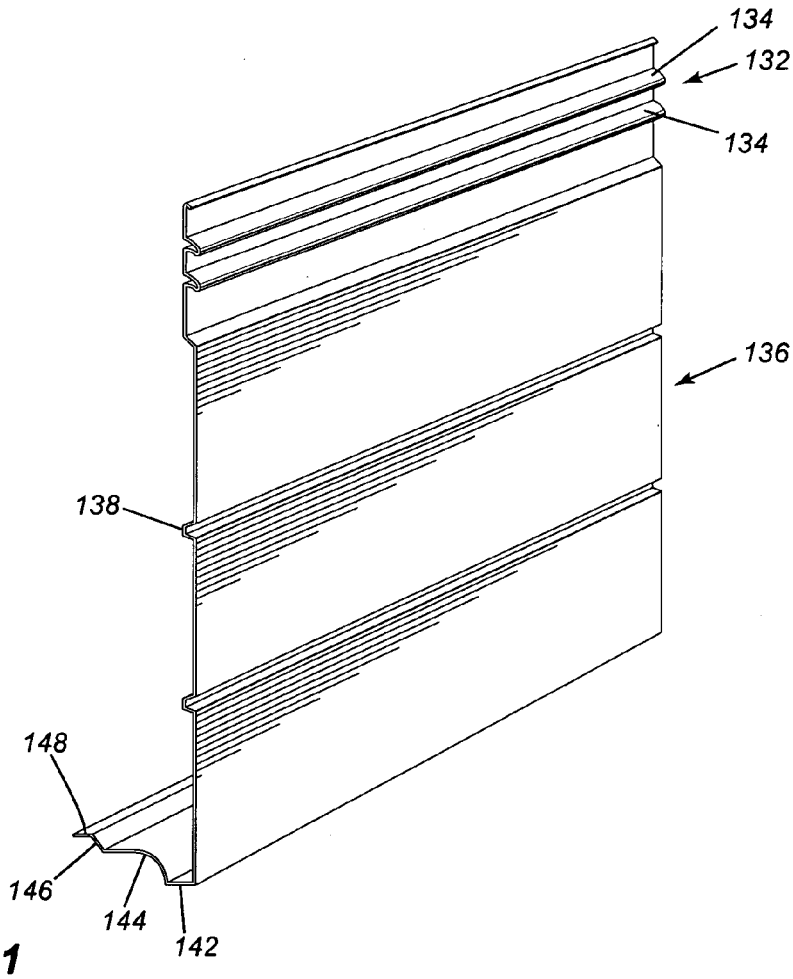
FIG. 11 is a perspective view thereof.

In use, and referring to FIGS. 8 and 9, first member 12 is installed in a position on roof R with planar portion 114 being secured thereto by suitable means (not shown). This thus provides a drip edge 118 with vertical portions 124 and 126 lying parallel to a fascia board F.

Spacer and tensioning member 150 may then be secured in the position to fascia board F and subsequently, second member 130 is hung in a position and supported by first member 112. In this regard, hook shaped projections 134 are engaged within recesses 128 of first member 112. Spacer and tensioning member 150 seats within cavity or a pocket 145 of second member 130 and maintains a tension on second member 130 to ensure hook shaped projections 134 remain engaged within recesses 128. Inwardly extending flange portion 140 is arranged to engage a soffit S and support one edge thereof.

As seen in FIG. 7, the structure of the present invention provides for adjustability. Thus, a first member 112 may assume different positions depending upon the particular engagement of projections 134 with recesses 128.

It will be understood that the above described embodiment is for purposes of illustration only and that changes and modifications may be made thereto without departing from spirit and scope of the invention.

We claim:

1. A fascia and soffit system comprising a fascia component, a soffit component, and a soffit support structure;

said fascia component comprising a first member and a second member, said first member having an upper section designed for securement to an upper surface of a roof member, a drip edge formed at an extremity of said upper section and extending outwardly away from said roof, a transition section extending inwardly and downwardly from said first section, and a lower section extending vertically downwardly from said transition section, said lower section having first cooperative locking means on an inner side thereof;

said second member comprising a fascia member having second cooperative locking means extending outwardly from, an upper portion of said fascia member;

an inwardly extending flange arrangement at the bottom end of said generally planar portion designed to abut an adjoining soffit;

said soffit support structure comprising:

a first member having a central vertical section, a support element extending outwardly from a lower portion of said central vertical section, a retaining structure located proximate an upper portion of said central vertical section;

a second member, having a second member central section adapted to lie adjacent said central section of said first member, said second member having engaging means located at a lower portion of said central section, said engaging means being designed to engage said support element of said first member, said second member having a second portion extending upwardly and outwardly to abut a soffit;

the arrangement being such that said second member central section is retained between said retaining structure of said first member and said support element of said first member.

2. The system of claim 1 wherein said support element comprises an outwardly directed flange, said vertical section of said second i ember having a plurality of projections extending outwardly towards said first member, the arrangement being such that said projections rest on said outwardly directed flange.

3. The system of claim 1 wherein said first member and said second member are formed from metallic sheet material.

4. The system of claim 3 wherein said metallic sheet material is selected from the group consisting of aluminum and aluminum alloys.

5. The system of claim 1 wherein said retaining means first member has a U-shaped channel sized to frictionally receive and engage said planar portion of said second member.

6. A fascia and soffit system comprising a fascia component, a soffit component, and a soffit support structure;

said fascia component comprising a first member and a second member, said first member having an upper section designed for securement to an upper surface of a roof member, a drip edge formed at an extremity of said upper section and extending outwardly away from said roof, a transition section extending inwardly and downwardly from said first section, and a lower section extending vertically downwardly from said transition section, said lower section having first cooperative locking means on an inner side thereof;

said second member comprising a fascia member having second cooperative locking means extending outwardly from an upper portion of said fascia member;

said soffit support structure comprising:

an inwardly extending flange arrangement at the bottom end of said generally planar portion designed to abut an adjoining soffit;

a tensioning member for mounting to a facia, said tensioning member being designed to abut and bias said inwardly extending flange alignment;

said soffit support structure comprising:

a first member having a central vertical section, a support element extending outwardly from a lower portion of said central vertical section, a retaining structure located proximate an upper portion of said central vertical section;

a second member having a second member central section adapted to lie adjacent said central section of said first member, said second member having engaging means located at a lower, portion of said central section, said engaging means being designed to engage said support element of said first member, said second member having a second portion extending upwardly and outwardly to abut a soffit;

the arrangement being such that said second member central section is retained between said retaining structure of said first member and said support element of said first member.

7. The system of claim 6 wherein said support element comprises an outwardly directed flange, said vertical section of said second member having a plurality of projections extending outwardly towards said first member, the arrangement being such that said projections rest on said outwardly directed flange.

* * * * *